US005795279A

United States Patent [19]

Shieh

[11] Patent Number: 5,795,279

[45] Date of Patent: Aug. 18, 1998

[54] PAINT ROLLER

[76] Inventor: Jin-Fu Shieh, No. 9, Lane 95, Chung-Shin Rd., Sec. 1, Wu Ku Hsiang, Taipei Hsien, Taiwan

[21] Appl. No.: 618,141

[22] Filed: Mar. 19, 1996

[51] Int. Cl.[6] ..... B65C 17/02

[52] U.S. Cl. ..... 492/13; 15/230.11; 401/197; 401/208

[58] Field of Search ..... 492/13; 15/230.11, 15/118; D4/122; 401/197, 208

[56] References Cited

U.S. PATENT DOCUMENTS

| | | | |
|---|---|---|---|
| 2,325,867 | 8/1943 | Matsakas | 401/197 |
| 2,743,469 | 5/1956 | Ditch | D4/122 |
| 3,812,782 | 5/1974 | Funahashi | 401/197 |
| 3,877,823 | 4/1975 | Leland | 401/197 |
| 4,458,399 | 7/1984 | Kessler | 401/197 |
| 4,583,876 | 4/1986 | Karliner et al. | 401/197 |
| 4,728,213 | 3/1988 | Geberth, Jr. | 401/197 |
| 5,345,648 | 9/1994 | Graves | 15/230.11 |
| 5,584,092 | 12/1996 | Polzin et al. | 15/230.11 |
| 5,619,769 | 4/1997 | Hutt | 401/197 |

*Primary Examiner*—Larry I. Schwartz
*Assistant Examiner*—Marc W. Butler
*Attorney, Agent, or Firm*—Browdy and Neimark

[57] ABSTRACT

A paint roller including a roller, a handle, and a bridge and socket assembly connected to the handle to hold the roller, wherein the roller includes a paint storage barrel for storing paint, the paint storage barrel having a fixed end cap at one end, an opening at an opposite end, and a plurality of longitudinal slots equally spaced around the periphery; a first cylindrical sponge fixedly mounted around the paint storage barrel to absorb paint from the paint storage barrel through the longitudinal slots of the paint storage barrel; a hollow cylindrical connector connected to the opening of the paint storage barrel, having a coupling portion at one end fastened to the paint storage barrel, an inner thread at an opposite end, and a plurality of longitudinal slots equally spaced around the periphery; a second cylindrical sponge fixedly mounted around the connector; and a detachable end cap having an outer thread at an inner side threaded into the inner thread of the connector and a handle at an outer side for turning by hand.

4 Claims, 6 Drawing Sheets

PAINT ROLLER

BACKGROUND OF THE INVENTION

The present invention relates to paint rollers, and relates more particularly to such a paint roller which supplies paint automatically when the roller is moved along the wall.

A variety of paint-brushes and paint rollers have been disclosed for the application of paint to the desired surface. A paint roller can apply paint to the desired surface evenly and efficiently. For a big area painting, paint rollers are commonly used rather than paint brushes. However, when a paint roller is used, it must be repeatedly dipped in paint to suck it in for application to the wall surface to be paint. When moving between the wall surface and the and paint container, paint tends to drop from the paint roller to the nearby area.

SUMMARY OF THE INVENTION

It is the main object of the present invention to provide a paint roller which automatically supplies paint when operated. According to the preferred embodiment of the present invention, the paint roller comprises a roller, a handle, and a bridge and socket assembly connected to the handle to hold the roller, wherein the roller comprises a paint storage barrel for storing paint, the paint storage barrel having a fixed end cap at one end, an opening at an opposite end, and a plurality of longitudinal slots equally spaced around the periphery; a first cylindrical sponge fixedly mounted around the paint storage barrel to absorb paint from the paint storage barrel through the longitudinal slots of the paint storage barrel; a hollow cylindrical connector connected to the opening of the paint storage barrel, having a coupling portion at one end fastened to the paint storage barrel, an inner thread at an opposite end, and a plurality of longitudinal slots equally spaced around the periphery; a second cylindrical sponge fixedly mounted around the connector; and a detachable end cap having an outer thread at an inner side threaded into the inner thread of the connector and a handle at an outer side for turning by hand.

DETAILED DESCRIPTION OF THE PREFERRED EMBODIMENT

Figure 1:
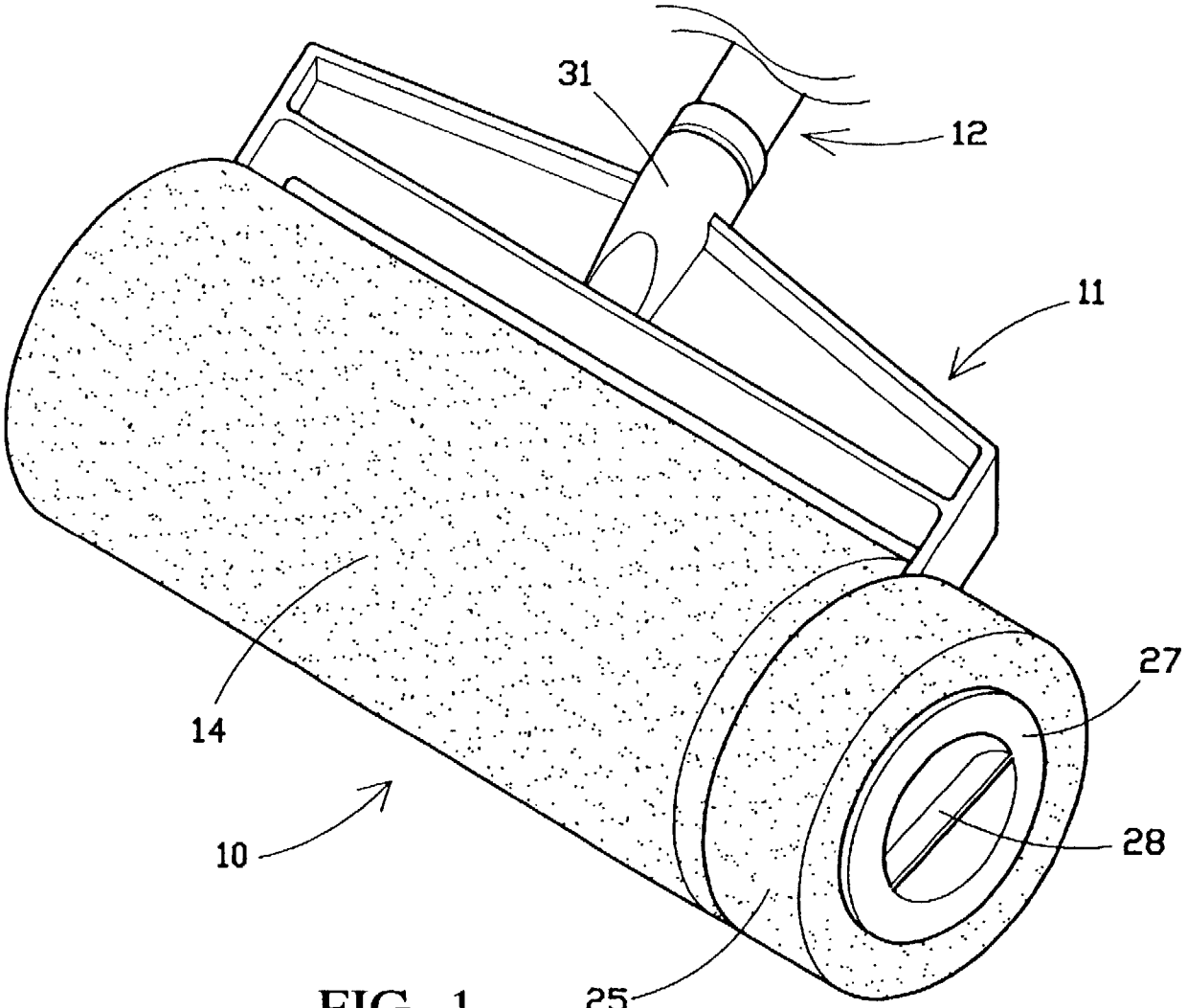
FIG. 1 is an elevational view of a paint roller according to the present invention.
Figure 2:
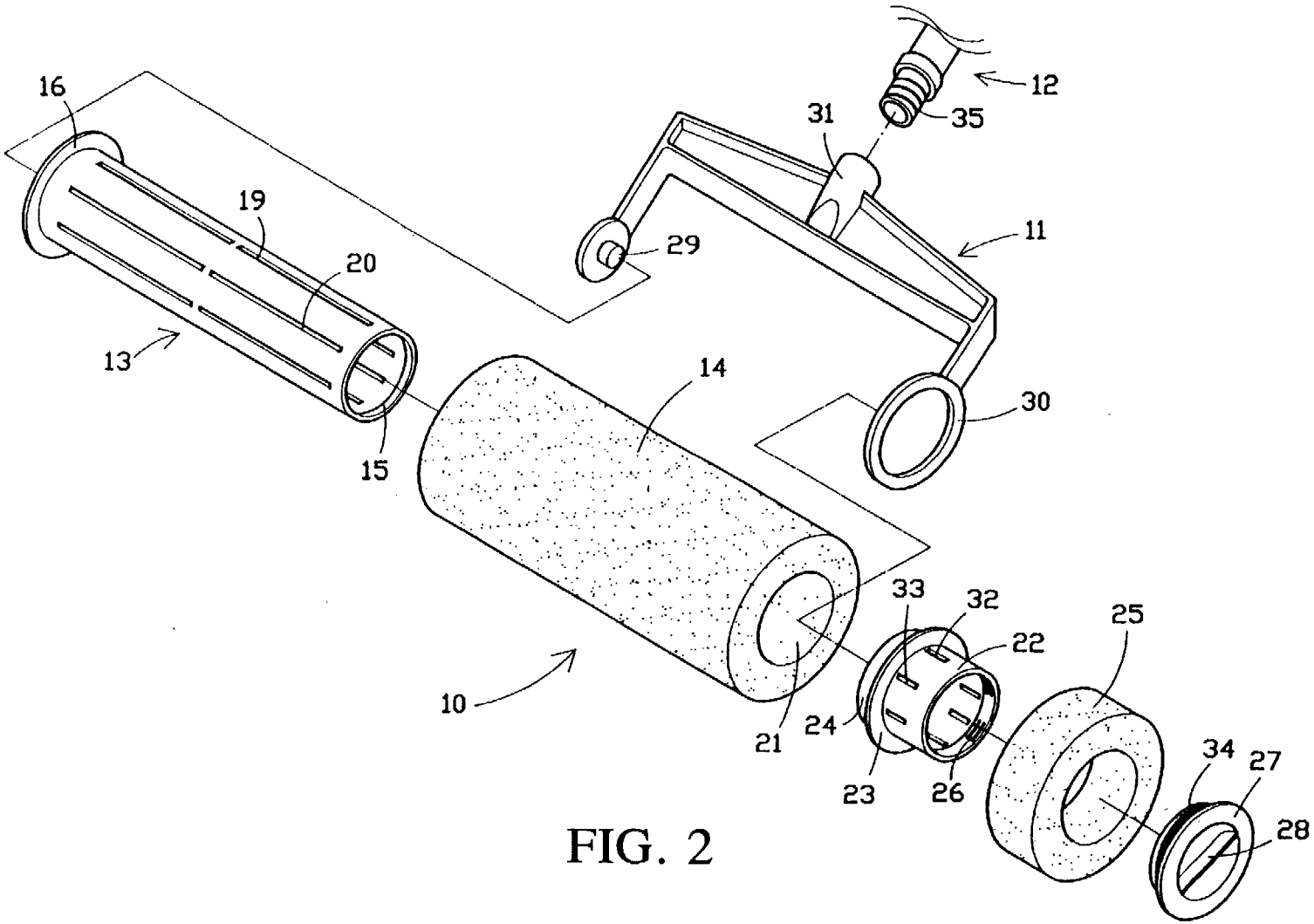
FIG. 2 is an exploded view of the paint roller shown in FIG. 1.
Figure 3:
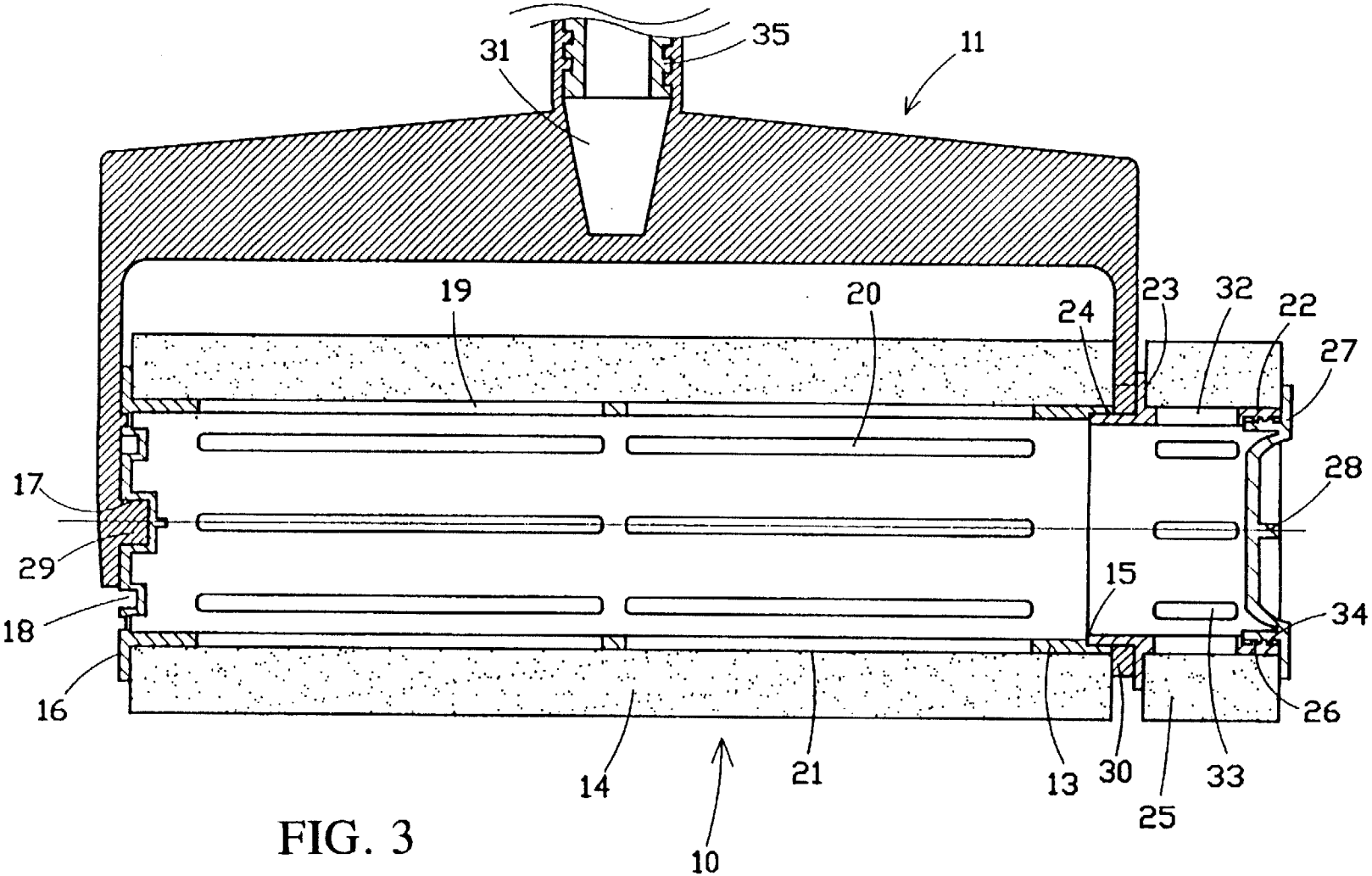
FIG. 3 is a front view in section of the paint roller shown in FIG. 1.
Figure 4:
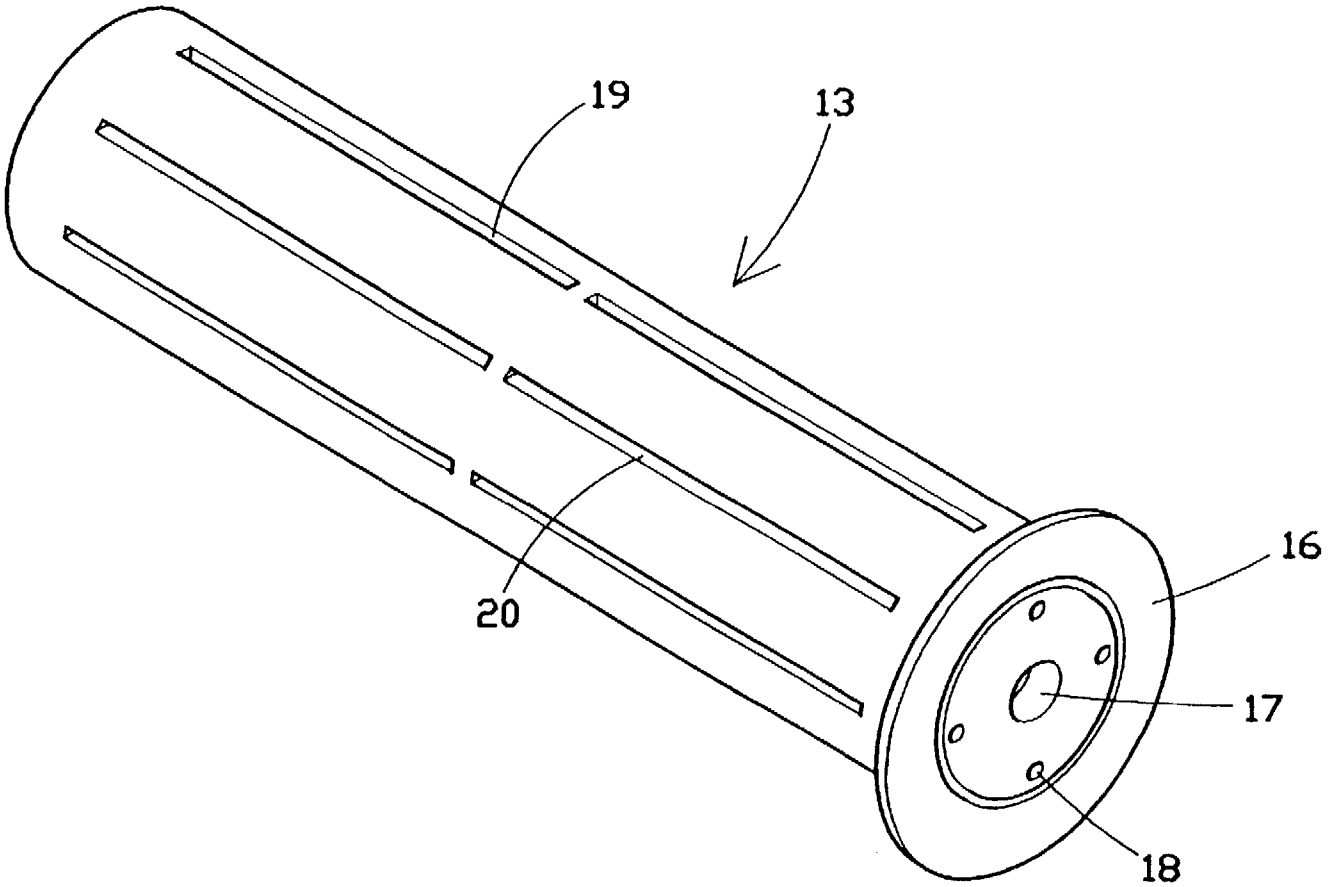
FIG. 4 is an elevational view in an enlarged scale of the paint storage barrel according to the present invention, showing locating holes made on the fixed end cap.
Figure 5:
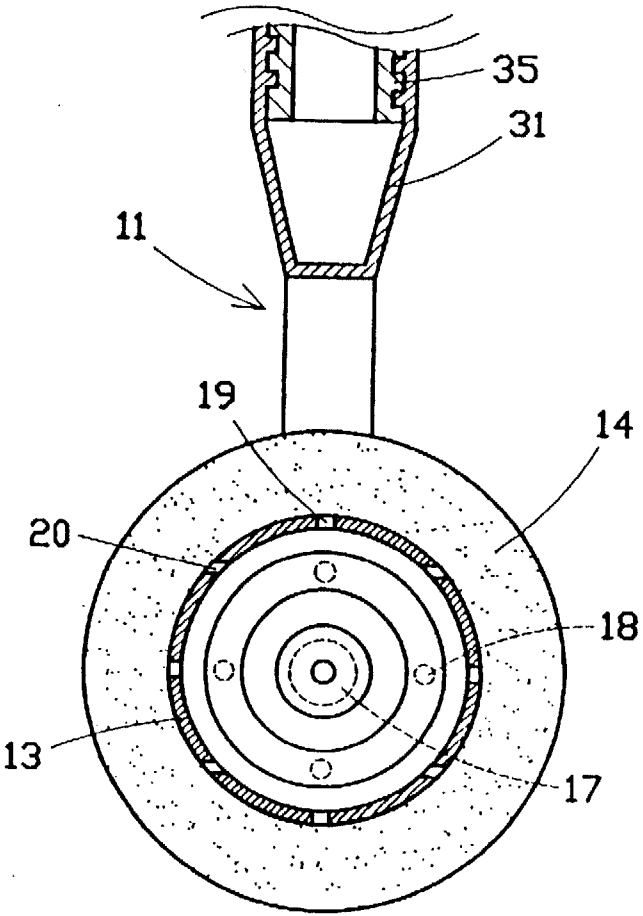
FIG. 5 is a side view in section of the paint roller showing in FIG. 1.
Figure 6:
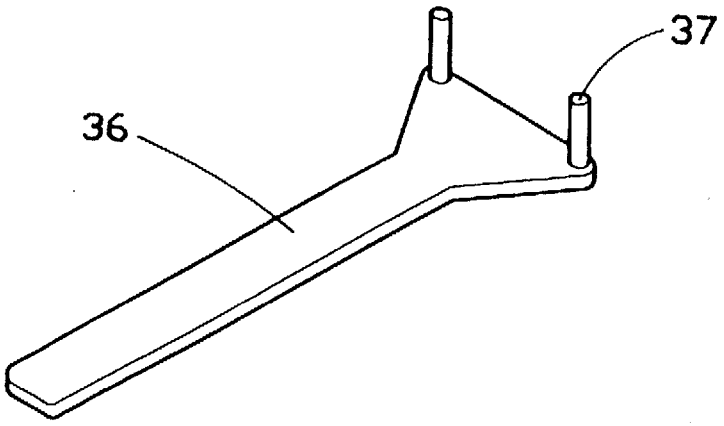
FIG. 6 is an elevational view of a spanner according to the present invention.

Referring to FIGS. 1, 2, and 3, a paint roller in accordance with the present invention is generally comprised of a roller 10, a bridge and socket assembly 11, and a handle 12. The roller 10 comprises a paint storage barrel 13, a first cylindrical sponge 14 mounted around the paint storage barrel 13, a connector fastened to the paint storage barrel 13 and the first cylindrical sponge 14 at one end, a second cylindrical sponge 25 mounted around the connector 22, and a detachable end cap 27 fastened to the connector 22. The paint storage barrel 13 has an opening 15 at one end, a fixed end cap 16 at an opposite end which has a center pivot hole 17 on the outside and four locating holes 18 equiangularly spaced around the center pivot hole 17 (see FIG. 4), a plurality of first longitudinal slots 19 and second longitudinal slots 20 alternatively spaced around the periphery, wherein the cross section of each of the first longitudinal slots 19 extends radially from the outside of the paint storage barrel 13 to the inside thereof; the cross section of each of the second longitudinal slots 20 slopes in one direction (see FIG. 5). The cylindrical sponge 14 defines a longitudinal through hole 21, which receives the paint storage barrel 13. When the cylindrical sponge 14 is mounted around the paint storage barrel 13, it is fixedly secured to the paint storage barrel 13 by an adhesive, permitting one end of the first cylindrical sponge 14 to be stopped against the fixed end cap 16. The connector 22 is a hollow cylinder having a coupling portion 24 at one end fitted into the opening 15 of the paint storage barrel 13, an outward flange 23 raised around the periphery in the middle, a plurality of first longitudinal slots 32 and second longitudinal slots 33 alternatively spaced around the periphery corresponding to the first longitudinal slots 19 and second longitudinal slots 20 of the paint storage barrel 13, and an inner thread 26 at an opposite end. The second cylindrical sponge 25 is mounted around the connector 22 and covered over the longitudinal slots 32, 33. The detachable end cap 27 has an outer thread 34 at an inner side threaded into the inner thread 26 of the connector 22, and a handle 28 at an outer side for turning by hand. The bridge and socket assembly 11 has an inward pivot pin 29 at one end inserted into the center pivot hole 17 of the fixed end cap 16 of the paint storage barrel 13, a coupling ring 30 at an opposite end coupled to the coupling portion 24 of the connector 22, and an internally threaded socket 31 in the middle. The handle 12 has an outer thread 35 at one end threaded into the internally threaded socket 31 of the bridge and socket assembly 11.

Referring to FIGS. from 1 to 3 again, when the inward pivot pin 29 and coupling ring 30 are respectively fastened to the center pivot hole 17 of the fixed end cap 16 of the paint storage barrel 13 and the coupling portion 24 of the connector 22, the coupling portion 24 is fitted into the opening 15 of the paint storage barrel 13 and fixedly secured thereto by an adhesive, then the second cylindrical sponge 25 is fixed to the connector 22, and then the detachable end cap 27 is fastened to the connector 22. When assembled, the paint storage barrel 13 can be rotated on the own axis relative to the bridge and socket assembly 11. When in use, the detachable end cap 27 is disconnected from the connector 22 to open the opening 15 for allowing paint to be filled into the paint storage barrel 13. When the roller 10 is pressed against the wall and moved, paint flows out of the longitudinal slots 19, 20, 32, 33 and applied to the wall by the sponges 14, 25.

When to disconnect the detachable end cap 27 from the connector 22, a spanner 36 may be used to hold down the fixed end cap 16 of the paint storage barrel 13 so that the detachable end cap 27 can be positively turned relative to the connector 22. The spanner 36 has two upright pins 37 at one end for inserting into the locating holes 18 of the fixed end cap 16 to stop the paint storage barrel 13 from rotary motion relative to the detachable end cap 27.

While only one embodiment of the present invention has been shown and described, it will be understood that various modifications and changes could be made without departing from the spirit and scope of the invention disclosed.

What the invention claimed is:

1. A paint roller comprising a roller, a handle, and a bridge and socket assembly connected to said handle to hold said roller, wherein said roller comprises:

a paint storage barrel for storing paint, said paint storage barrel having a fixed end cap at one end, an opening at an opposite end, and a plurality of longitudinal slots equally spaced around the periphery;

a first cylindrical sponge fixedly mounted around said paint storage barrel to absorb paint from said paint storage barrel through the longitudinal slots of said paint storage barrel;

a hollow cylindrical connector connected to the opening of said paint storage barrel, having a coupling portion at one end fastened to said paint storage barrel, an inner thread at an opposite end, and a plurality of longitudinal slots equally spaced around the periphery;

a second cylindrical sponge fixedly mounted around said connector; and a detachable end cap having an outer thread at an inner side threaded into the inner thread of said connector and a handle at an outer side for turning by hand.

2. The paint roller of claim 1 wherein the longitudinal slots of said paint storage barrel and said connector include a plurality of first longitudinal slots and second longitudinal slots alternatively arranged around the periphery of said paint storage barrel and said connector, the cross section of each of said first longitudinal slots extending radially from the outside of said roller toward the inside, the cross section of each of said second longitudinal slots sloping in one direction from the outside of said roller toward the inside.

3. The paint roller of claim 1 wherein said fixed end cap of said paint storage barrel has four equiangularly spaced locating holes at an outer side for the attachment of a spanner to hold down said paint storage barrel when said detachable end cap is turned outwards from said connector.

4. The paint roller of claim 1 wherein said bridge and socket assembly comprises an inward pivot pin at one end inserted into a pivot hole on said fixed end cap of said paint storage barrel, a coupling ring at an opposite end coupled to the coupling portion of said connector, and an internally threaded socket in the middle; said handle has an outer thread at one end threaded into the internally threaded socket of said bridge and socket assembly; said end cap of said paint storage barrel has a center pivot hole at an outer side which receives the pivot pin of said bridge and socket assembly.

* * * * *